US005749652A

United States Patent [19]

Brunn et al.

[11] Patent Number: 5,749,652

[45] Date of Patent: May 12, 1998

[54] MIXING APPARATUS AND METHOD

[75] Inventors: Randy J. Brunn, Brooklyn Park; William O. Gran, Circle Pines; James P. Junk, Bloomington, all of Minn.

[73] Assignee: Red Devil Equipment Company, Brooklyn Park, Minn.

[21] Appl. No.: 620,800

[22] Filed: Mar. 28, 1996

Related U.S. Application Data

[63] Continuation-in-part of Ser. No. 411,948, Mar. 28, 1995, abandoned, which is a continuation-in-part of Ser. No. 330,122, Oct. 27, 1994, abandoned.

[51] Int. Cl.[6] ..... B01F 11/00

[52] U.S. Cl. ..... 366/209; 366/219; 366/605

[58] Field of Search ..... 366/208, 209, 366/212, 213, 214, 219, 605

[56] References Cited

U.S. PATENT DOCUMENTS

| | | | |
|---|---|---|---|
| 3,346,241 | 10/1967 | Schubert . | |
| 4,134,689 | 1/1979 | Ahrenskou-Sorenson . | |
| 4,173,148 | 11/1979 | Vork | 366/209 |
| 4,173,418 | 11/1979 | Vork . | |
| 4,281,936 | 8/1981 | Schotter et al. . | |
| 4,497,581 | 2/1985 | Miller . | |
| 4,588,302 | 5/1986 | Pizzi . | |
| 4,702,610 | 10/1987 | Reynolds, Jr. . | |
| 4,747,693 | 5/1988 | Kahl . | |
| 4,789,245 | 12/1988 | Morbeck . | |
| 4,834,548 | 5/1989 | Tempel | 366/208 |
| 5,050,996 | 9/1991 | Allen . | |
| 5,060,151 | 10/1991 | Mikyska . | |
| 5,261,744 | 11/1993 | Brunn . | |
| 5,372,425 | 12/1994 | Tannenbaum . | |
| 5,443,314 | 8/1995 | Gatlin | 366/208 |
| 5,507,575 | 4/1996 | Rossett | 366/605 |

FOREIGN PATENT DOCUMENTS

| | | |
|---|---|---|
| 0617998 | 10/1994 | European Pat. Off. . |
| 1291424 | 2/1987 | U.S.S.R. . |
| 0889568 | 2/1962 | United Kingdom . |
| 2045101 | 10/1980 | United Kingdom . |
| 9108045 | 6/1991 | WIPO . |

*Primary Examiner*—Randall Chin
*Attorney, Agent, or Firm*—Dorsey & Whitney LLP

[57] ABSTRACT

The present invention provides a mixing apparatus and method for mixing fluent material such as paint or the like in a container. The apparatus includes a main frame and a subframe movably connected to the main frame. A drive motor is mounted on the main frame, and a container receiving and securing support is mounted on the subframe. A transmission mounted on the main frame operably connects the motor and the subframe, and converts the rotary output of the motor to a circular motion of the subframe. In operation, the circular motion agitates the fluent material in the container to mix it in a short period without producing the destructive forces leading to mechanical breakdowns associated with other mixers.

13 Claims, 9 Drawing Sheets

MIXING APPARATUS AND METHOD

This application is a continuation-in-part of U.S. application Ser. No. 08/411,948, filed Mar. 28, 1995, now abandoned, which is in turn a continuation-in-part of U.S. application Ser. No. 08/330,122, filed Oct. 27, 1994, now abandoned.

BACKGROUND OF THE INVENTION

1. Field of the Invention

The present invention relates to devices for mixing or agitating. In particular, it relates to an apparatus and method for mixing fluent material including liquids such as paint or the like.

2. Description of the Prior Art

Mixing devices take many forms, usually determined by the subject material to be mixed. In the case of liquids or fluent material, such devices may include mechanical stirrers or injectors to produce agitation or turbulence in the materials to be mixed. This type of mixer requires an open container or at least openings into a container. Another way to generate the turbulence required to mix two or more materials is to contain the subject materials in a closed vessel and subject the vessel and its contents to movement. The latter type of mixing device is used widely in the retail industry for mixing paint in the can or container at the time of purchase. It is also used in industry for heavy duty applications. Typically, such machines include a container receiving and gripping structure for receiving and holding the can or container of material to be mixed, and one or more motors for providing mixing motion.

The mixing motion providing agitation and mixing of a subject material may be generated by mixers providing a simple oscillatory or vibrating motion wherein the container or can is simply shaken rapidly back and forth through a short distance. More advanced mixing devices provide a gyroscopic motion wherein a container is moved, usually rotated, about one axis while simultaneously being moved, usually spun, about a second axis perpendicular to the first. U.S. Pat. Nos. 4,281,936 issued to Schotter et al. and 4,789,245 issued to Morbeck disclose paint mixing machines which provide a combined tumbling and rotating motion (Schotter et al.) or a gyratory motion (Morbeck) for mixing paint.

U.S. Pat. No. 5,261,744 issued to Brunn discloses an improved mixing apparatus for providing gyroscopic movement to a paint or flowable material in a container. The disclosed apparatus overcomes maintenance problems that exist with other mixers because it provides the mixing movement to the container by a direct drive system, rather than through a belt drive system such as that disclosed in the Morbeck patent. However, the Brunn mixing apparatus relies on a gyroscope movement including a complete revolution of the container, resulting in a movement with a large circumference. Although it provides highly acceptable mixing, the circumferential movement requires more space than is acceptable for some applications and it does not automatically accommodate a variety of container sizes.

U.S. Pat. No. 5,443,314 issued to Gatlin discloses a mixing assembly having a rigid frame and a support frame, wherein the rigid frame is movable with respect to the support frame and carries a container clamping device for clamping a container to the rigid frame. The two frames are connected at three coplanar axle/bearing arrangements. The assembly provides for moving a container of liquid in a circular planar orbit about an axis normal to the plane of the orbit in an upright position. Like typical known mixers, the Gatlin mixing assembly is designed to mix or agitate the contents of the container by repeatedly moving the container a relatively small distance or displacement (an orbital radius of ⅞ of an inch) at a high speed (680–700 rpm). The combination of small displacement and high speed generates at least two problems: (1) break-up of the air pocket at the top of the container, thereby resulting in foaming and entrainment of bubbles in the liquid being mixed, and (2) heavy wear and tear on the mixing assembly. Further, the container clamping device of Gatlin is designed for a container of a single size, thus significantly reducing its flexibility and rendering it totally inapplicable for a general purpose mixer.

Vork U.S. Pat. No. 4,173,418 shows a circular mixing motion similar in many ways to that of Gatlin '314. Vork is also limited to a single container size and is intended to be operated at high speed (400–600 rpm) and small displacement (1–2 inches).

Other patents such as Gatlin U.S. Pat. No. 5,462,353 teach moving the container in generally elliptical path by pivoting the lower end of the container support in a circular path about a fixed axis and allowing the top end to oscillate in a generally vertical direction relative to a rocker arm. This motion imparts Jerk (change of acceleration relative to time), and thus improves mixing to some extent, but also significantly increase wear and stress on the mixer, thereby resulting in maintenance and durability problems.

Accordingly, there is a need in the art for a mixing apparatus and method, particularly a paint mixer and paint mixing method, for industrial and retail use which minimizes maintenance and durability problems that exist with current mixers, yet provides adequate mixing and occupies a minimum amount of floor space. A need also exists for a paint mixer which minimizes or eliminates the break-up of air pockets in the container and consequent entrainment of tiny air bubbles in the paint. A still further need exists for a mixing apparatus and method with an efficient multi-sized container clamping mechanism for securing the container to the mixing device.

SUMMARY OF THE INVENTION

The problems outlined above are in large part solved by the apparatus and method in accordance with the present invention. The apparatus includes a frame, a container support connected to the frame, a motor and a transmission, including an offset link, connecting the motor and the container support. In contrast to known mixing apparatus, the mixer of the present invention does not produce or require gyroscopic or extreme vibratory movement nor does it produce high speed circular movement with a small displacement. Such prior art movements result in significant wear and tear on the mixer, with consequent maintenance and downtime.

More specifically, the frame of the mixing machine of the present invention includes a main fixed support frame and a movable subframe. The drive motor and a portion of a transmission are fixedly mounted on the main frame. The movable subframe is coupled to the output of the transmission by an offset link and to the main frame by a secondary guiding and supporting linkage arrangement for guiding and moving the subframe, and thus the container, in a circular orbit with a relatively large displacement and slow speed. The movable subframe carries a container securing means comprising a bottom container receiving clamp plate and a frame assembly which supports and guides a driven top container receiving clamp plate. The top clamp plate is movable to accommodate the mounting of a variety of container sizes. The frame assembly also carries a motor and transmission for driving the top clamp plate. A counterweight assembly, including a plurality of counterweights, is coupled to the secondary linkage arrangement to provide stability to the apparatus regardless of the size of the container being mixed. An enclosure cabinet or shroud may enclose the entire machine, and controls, including an electronic control module and a soft start control module, may be suitably associated with the machine in the cabinet.

The present invention also encompasses a method of mixing a fluid in a fluid container comprising the steps of providing a fluid container support, securing a fluid container in the fluid container support and moving said fluid container support in a circular orbital path in a single plane about a horizontal orbital axis with a displacement and at a speed which preferably does not cause break-up and dissipation of any air pocket in the container. This results in speeds significantly slower than the teachings of the prior art. In fact, with the apparatus and method of the present invention, comparable mixing can be achieved at speeds less than one-half that of similar prior art mixers. Thus, the present invention is in direct contrast to the prevailing view that increased mixing is achieved by increased mixing speed.

An object of the present invention, particularly the method thereof, is to use a circular mixing motion having a relatively large diametric (and radial) displacement at a relatively slow speed to mix a fluid, particularly paint, in a short period of time without producing foaming or air entrapment in the fluid. Preferably the displacement and speed is sufficiently large and slow to maintain any air pocket within the container substantially intact and causes it to move within the container along a path which includes both vertical and horizontal components. Accordingly, one aspect of the method of the present invention takes advantage of the air pocket found in most paint containers. It is to be understood, however, that many of the advantages of the present invention can be achieved even without an air pocket. Thus, in contrast to mixers which try to achieve mixing by using high speed oscillatory or vibratory motion over short distances, the mixing apparatus and method of the present invention accomplishes mixing by using relatively slow speeds and large displacements. This substantially reduces wear and tear on the machine and significantly reduces the entrapment of air bubbles in the mixed paint.

The method of the present invention may be used to mix fluid in various sizes of containers and, in one embodiment, is adapted for use in mixing the contents of a fluid container no greater than about five gallons (or 20 liters) in volume.

The securing step of the method of the present invention further includes securing the fluid container in a fixed position relative to the fluid container support and, wherein a typical fluid container includes an openable top, a bottom, a sidewall joining the top and bottom and a container axis extending centrally through the top and bottom, securing the fluid container in the fluid container support such that the container axis extends generally vertically.

It is an object of the present invention to provide for the safe, efficient and complete mixing of flowable material, including liquids such as paint, ink, liquid food products, or the like.

Another object of the present invention is to provide a mixer with a small footprint and overall size to conserve valuable retail and industrial space. It is also an object to provide a mixer that is quiet to avoid disruptions and distractions, particularly in a retail setting, and that is safe for operation in retail settings. The safety of the present invention is enhanced because the moving parts, frame assemblies and electronics are completely enclosed in a cabinet. All clamping and mixing operations are initiated and controlled by control inputs (e.g., buttons, switches, timers and the like) on the exterior of the cabinet and occur within the cabinet after the cabinet door is closed.

Another object of the present invention is to provide for easy loading and unloading of the mixing machine of the present invention. This advantage is achieved by the balancing interaction of the weight of the counterweights and the movable portion of the machine and the size (and weight) of the container of material to be mixed. At a container weight of forty pounds, when a mixing cycle is complete, the machine (particularly, the container receiving and holding portion) will come to rest at any point around the path of the circular mixing motion. When the container weight varies from forty pounds, for example, when the container size is one gallon or less, at the end of a mixing cycle, the machine (particularly, the container receiving and holding portion) usually stops at the top of the circular mixing motion because the counterweights are heavier than the opposing force generated by the weight of the container and its contents. If a five gallon container, is being mixed, the machine will tend to come to rest at the bottom of the circular mixing motion because the counterweights are relatively lighter than the container and its contents.

Another object of the present invention is to provide a mixing device for mixing paint in a closed container which uses direct drive to provide a substantially two dimensional movement, yet which achieves complete and efficient mixing of the paint in a short period of time, preferably within two minutes. To achieve mixing in the desired short period of time, the mixer of the present invention provides circular motion with vertical displacement of four to eight inches, at a velocity of less than 100 inches per second, preferably 45–75 inches per second, and most preferably 45–65 inches per second. This results in an acceleration component from about 800–1500 inches per second squared and a speed of about 100–200 rpm, creating a vortex in the container. To achieve a mixing time of two minutes or less, the mixer of the present invention is operated to provide a vertical displacement of seven inches, at a velocity of fifty-five in./sec., with an acceleration component of 860 in./sec.$^2$ and at a speed of 150 rpm. At a speed of 175 rpm, the velocity is 64 in./sec. and the acceleration is 1172 in./sec.$^2$. At a speed of 200 rpm, the velocity is 73 in./sec. and the acceleration is 1535 in./sec.$^2$.

Yet another object of the mixer of the present invention is to provide a circular mixing motion, with zero Jerk, wherein the motion is less violent than that customarily used to produce turbulence, and wherein the circular motion is at a speed (in revolutions per minute) substantially lower than the speeds at which currently available mixing apparatus operate.

Mixing turbulence in a liquid in a closed container is produced by energy. A component of the energy is velocity which in turn is a function of distance and time. Many known mixing devices use a small amount of movement or distance and a very high rate of speed to obtain the energy required to produce turbulence, in the process, generating large forces which are very destructive. To eliminate or reduce these destructive forces, it is an object of the present invention to maximize velocity by increasing the distance moved or displacement while reducing speed (rpm).

Still another object of the present invention is to eliminate the need to use a crank and rocker mixing mechanism of the prior art. The apparatus and method of the present invention uses a circular motion with a total vertical displacement of approximately 4–8 inches at 100–200 revolutions per minute. The circular motion imparts turbulence to the contents of the container by generating a mixing path including a liquid path component and, in those containers containing an air pocket along with the liquid (most containers), an air path component. The liquid path component is generally vertical, but slightly elliptical, and the air path component is generally transverse or angular relative to the liquid path component. Advantageously, the mixing path creates sufficient turbulence to completely mix the contents in a short amount of mixing time, yet does not require the short, choppy, abrupt, repetitive motion which causes the frequent breakdown of known mixers and the break-up of the air pocket into tiny air bubbles which become entrained in the liquid contents.

The secondary guiding and support linkage arrangement, particularly the counterweight assembly integrated therewith, provides for the smooth, quiet operation of the present invention, prevents movement of the entire machine when operating, and reduces wear in bearings at the movable portions of the machine. Specifically, the size of the counterweights and their position relative to the pivot axis are selected to provide maximum stability to the apparatus, despite the fact that the apparatus is adapted to accommodate different sizes of containers.

A still further object of the present invention is to provide a mixing apparatus which can be adapted easily for mixing fluent material contained in a range of container sizes, for mixing material in a number of containers at the same time (e.g., a case of one gallon paint cans), and which avoids complex, hand-operated clamping mechanisms and provides for easy loading and unloading. An advantage of the present invention is that it includes an electronically driven and controlled automatic clamp assembly, the operation of which is tied into the electronic control of the mixing operations, including the safety override and shut-off features of the mixing apparatus.

A further advantage of the present invention is that it includes a "black-box" electronic control module for controlling mixing, clamping and safety operations. In the unlikely event of a fault, the user may simply unplug one control module and plug in a replacement module, minimizing downtime.

These and other objects, features and advantages of the present invention will become more apparent with reference to the drawings, the description of the preferred embodiment and the appended claims.

DETAILED DESCRIPTION OF THE PREFERRED EMBODIMENT AND METHOD

The Figures depict the mixing device 10 of the present invention and features and components thereof. Although the preferred embodiments of the device 10 are intended primarily for use in mixing liquids, and particularly paint contained in quart, one-gallon or five-gallon (20 liter) containers, as well as cases of one-gallon containers, the device 10 could be used for mixing various other materials including powdered or granular materials.

With regard to means for fastening, mounting, attaching or connecting the components of the present invention to form the mixing apparatus 10 as a whole, unless specifically described as otherwise, such means are intended to encompass conventional fasteners such as machine screws, rivets, nuts and bolts, toggles, pins, or the like. Other fastening or attachment means appropriate for connecting components include adhesives, welding (e.g., frame members) and soldering, the latter particularly with regard to electrical connections. Unless specifically otherwise disclosed or taught, materials for making the components of the present invention are selected from appropriate materials such as aluminum, steel, metallic alloys, various plastics, plexiglass, fiberglass or the like.

Figure 1:
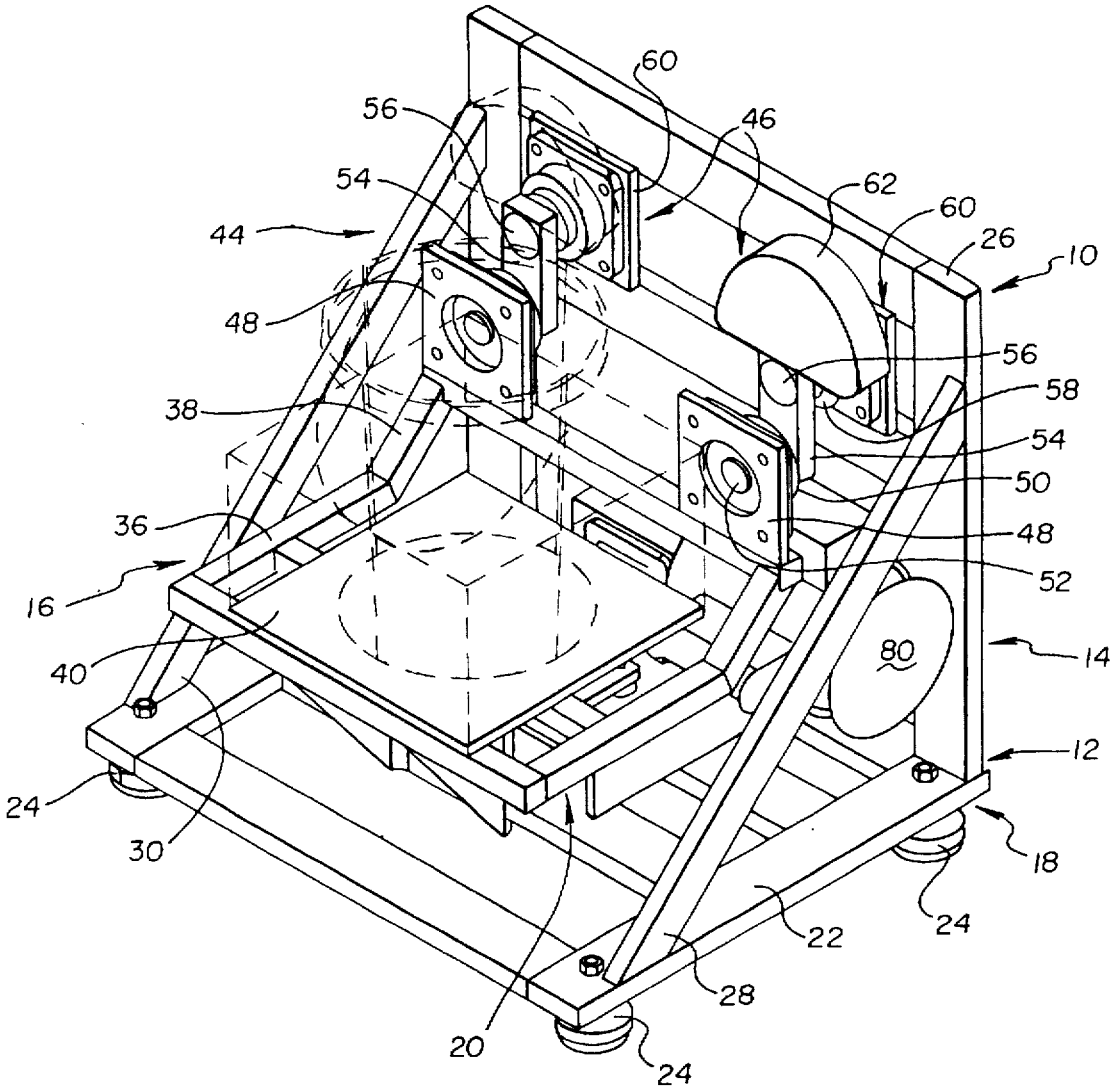
FIG. 1 is an isometric view of the mixing device of the present invention.

In the following description, any references to right and left, top and bottom, upper and lower and horizontal and vertical are to be read and understood with their conventional meanings and with reference to viewing the embodiments of the mixer 10 of the present invention as shown in FIG. 1, which is an isometric view of one embodiment, and FIG. 6, which is an isometric view of another embodiment as it might be disposed in use. Elements or components common to both embodiments of the present invention are commonly numbered.

Referring then to the drawings, particularly FIG. 1, the mixing device 10 of the present invention comprises a frame 12, a drive system 14 and a container receiver and support 16.

Figure 2:
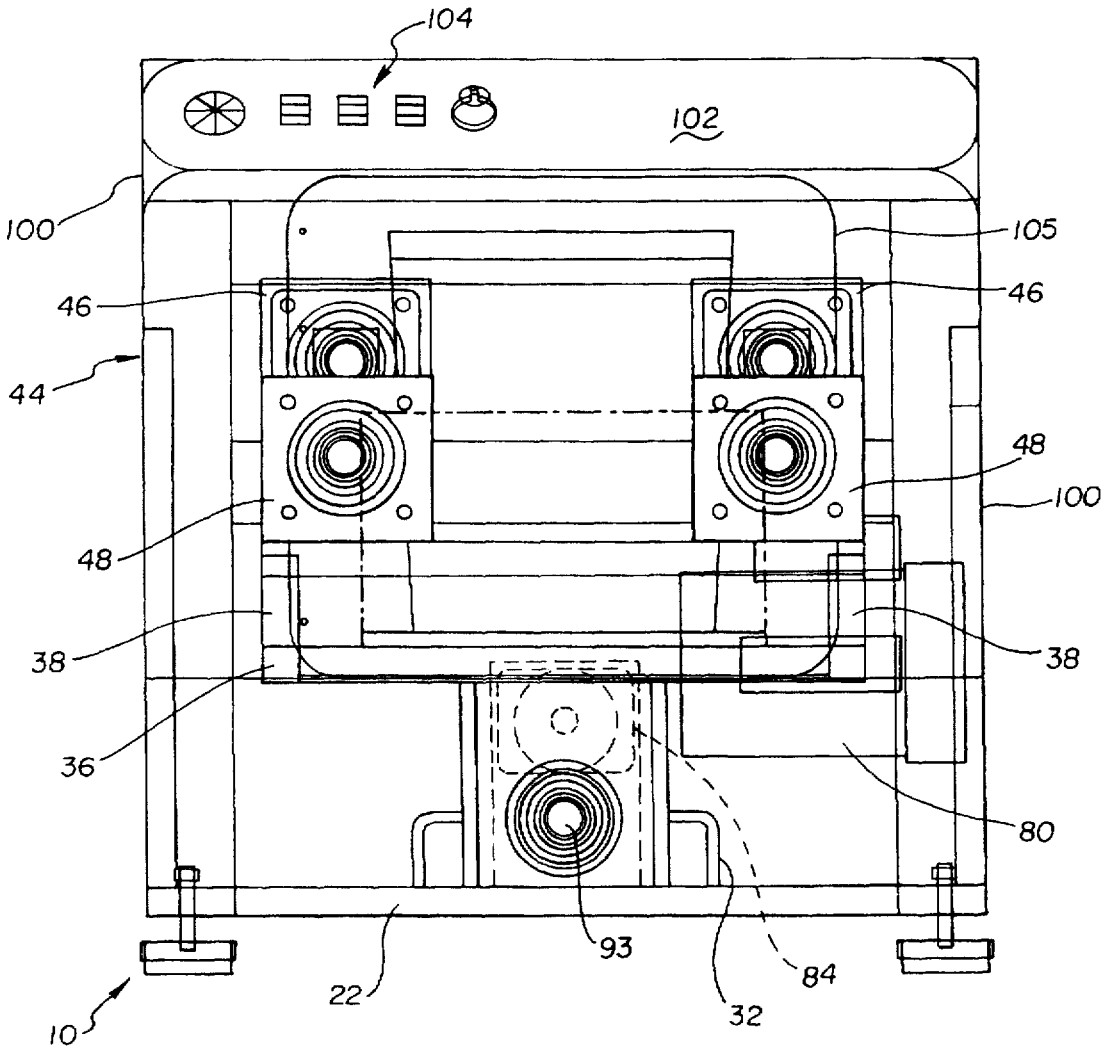
FIG. 2 is a front elevational view of the present invention.

The frame 12 has two parts, a rigid main frame 18 and a rigid subframe 20 movably coupled to the main frame 18. The main frame 18 includes a horizontal, flat base 22, which may be a solid plate or may comprise tubular framing members welded together at the depicted joints, corners, etc. Four non-skid, resilient, shock-absorbing feet 24 are mounted on the underside of the base 22, one at each corner. An upstanding, generally vertical frame member 26 is mounted on the top of the base 22 along its rear edge. Angular brace members 28, 30 buttress the upstanding frame member 26. Referring to FIG. 2, a generally central, inverted U-shaped solid support member 32 is connected to the base 22 in the central region thereof. It should be noted that the main frame 18, to which the subframe 20 is moveable connected, is not stabilized by springs or the like, despite the fact that the subframe includes a multiple size container clamp as will be described below.

Referring back to FIG. 1, the subframe 20 is movably coupled to the main frame 18, but is a discrete framing structure. The subframe 20 is formed by joined tubular framing members and includes a flat front portion 36 and a rear portion 38 that rises upwardly at an angle relative to the flat front portion 36. The subframe 20 supports a flat container receiving and supporting plate 40.

The main frame 18 and the subframe 20 are coupled through the drive means 14 as will be explained below and also by a secondary guiding and supporting, non-driven, idling linkage arrangement, indicated generally at 44. The secondary linkage arrangement 44 includes two substantially identical linkage members, both indicated at 46. Each member 46 includes a first generally vertical flange 48 fixedly attached to the rear portion 38 of the subframe 20. A self-aligning or floating bearing 50 is mounted centrally in each flange 48 for receiving a cylindrical straight stub shaft 52. The stub shaft 52 is rigidly connected to a solid straight link 54 at a 90° angle. At the other end of the link 54, a second stub shaft 56 extends rearwardly from the other side of the link 54 and is received in a bearing 58. The bearing 58 is secured to a flange 60 fixedly mounted on the upright member 26 of the main frame 18. The floating bearings 50 may be Sealmaster bearings, model SF-24T, but other suitable bearings may be used as well. The fixed bearings 58 connected to the main frame 18 (at the upright member 26) also may be Sealmaster bearings, model ER-24T. Each secondary linkage arrangement 46 includes a counterweight 62 (one of which is shown in phantom) fixedly connected to each link 54. As depicted in FIG. 4D, the counterweights 62 help balance and relieve stress on the machine 10, particularly when the drive means 14 is lifting a container of paint and the container receiver 16 on one side of the shaft (the shaft 81 and its axis A are depicted in FIG. 3), and the counterweights are providing an opposing force on the other side of the shaft.

Figure 5:
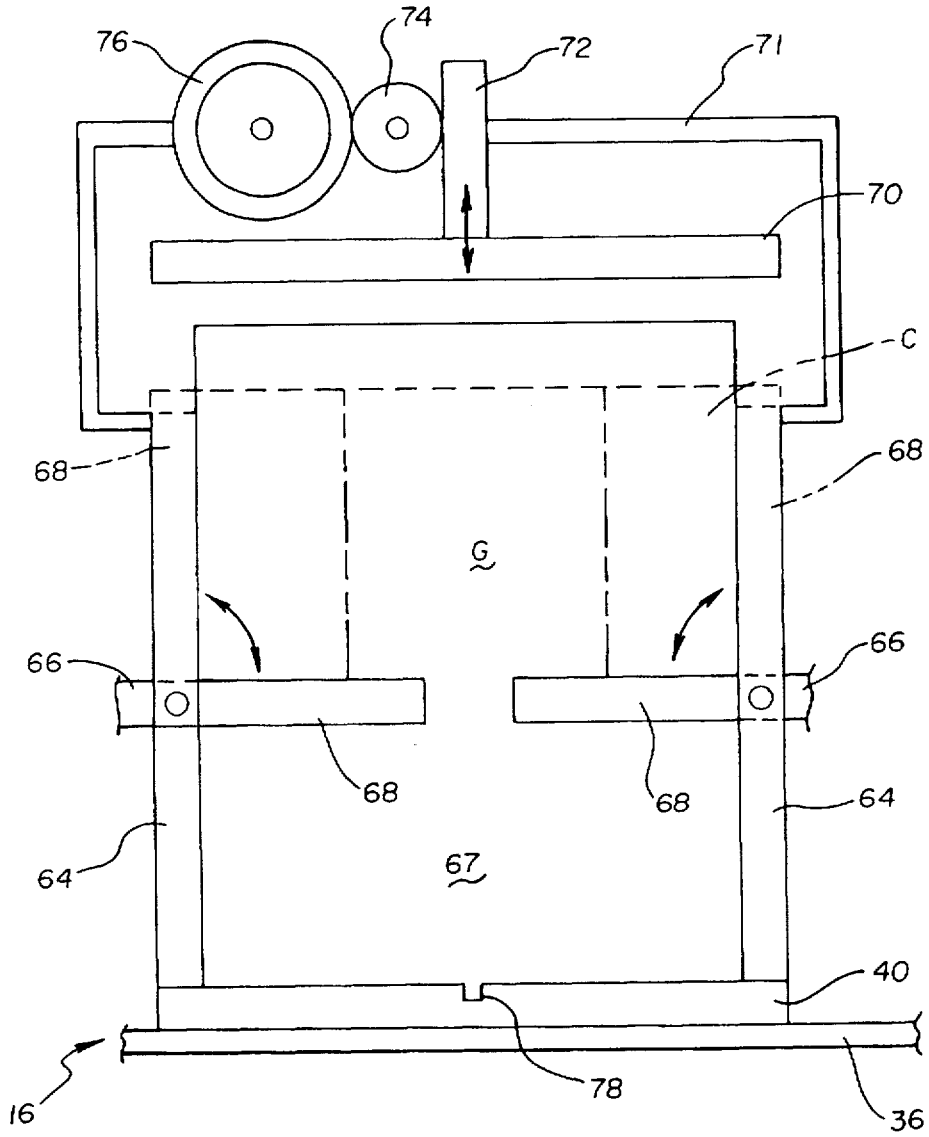
FIG. 5 is a representational view of one embodiment of an automatic clamping and hold mechanism for use on the subframe of the present invention to hold a container in place as the mixer is operated.

FIG. 5 depicts one embodiment of an automatic clamping mechanism for securing a container, whether a one-gallon can, a five-gallon can or a case of one-gallon cans, to the container receiver and support 16. The plate 40 is mounted on the forward portion 36 of the subframe 20. A receiving structure is formed on or with the plate 40 by two parallel vertical plates 64 and two generally horizontal plates 66. One horizontal plate 66 is joined to one vertical plate 64. The vertical plates 64 are fixed to the bottom plate 40 and the horizontal plates 66 are generally parallel to the bottom plate 40, thereby defining a generally central well 67 with an open upper end. A pair of adaptor hinge flanges 68 are pivotally coupled to the edges of the upper plates 66 to selectively close the open end of the well 67. The rest of the automatic clamping mechanism may be carried by a drive assembly frame 71 attached to vertical plates 64 and includes a top plate 70 movably coupled to the assembly frame 71 through a rack 72 which is operably coupled to and driven vertically by a pinion gear 74, in turn coupled to a suitable drive motor 76. A trigger sensor 78 for automatically actuating the opening of the adaptor flanges 68 may be provided on the bottom plate 40.

Referring back to FIG. 1, the drive means 14 (including output power and a transmission) includes an AC electric drive motor 80 mounted on the main frame 18. A suitable, one horsepower motor is manufactured by Franklin Electric (other specifications: 60 hertz, 1725 rpm output, 115/230 volts, 56 C frame); however, other suitable motors may be substituted so long as they produce the desired rotary output power.

Figure 3:
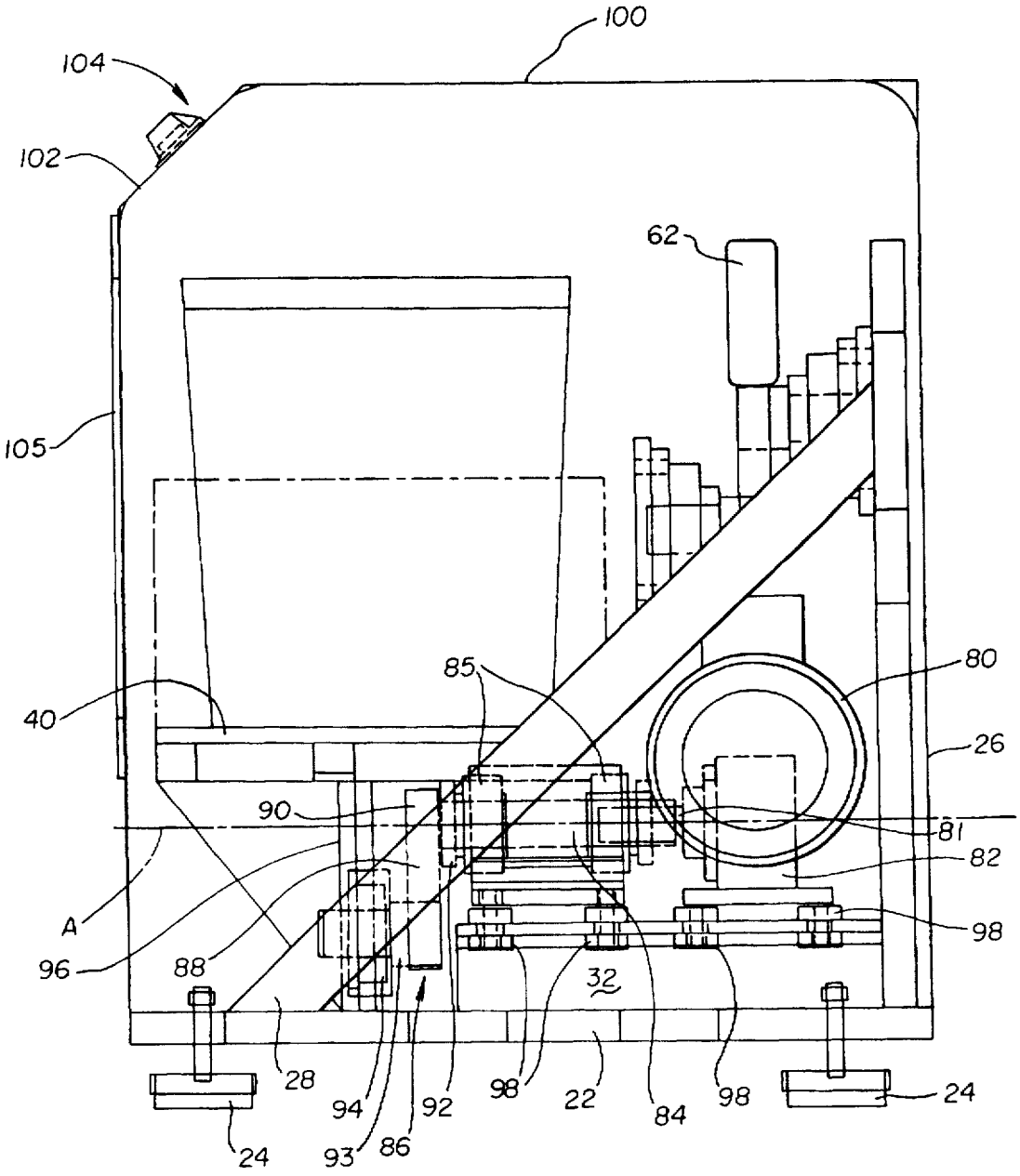
FIG. 3 is a right side elevational view with portions of the shroud broken away to show internal operating mechanisms and components of the present invention.
Figure 4A:
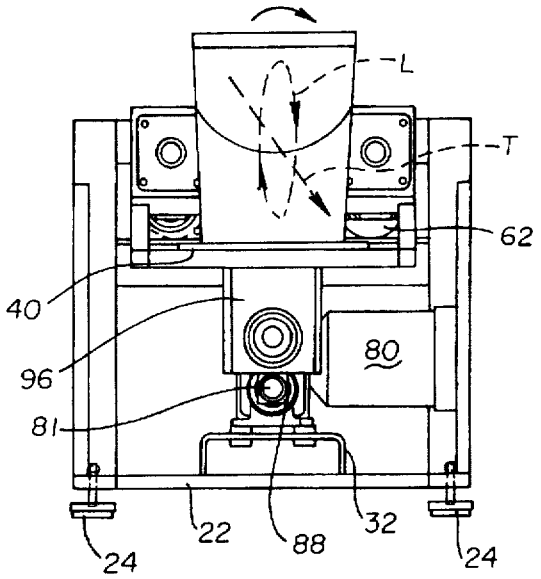
FIGS. 4A–D are front elevational views representing and depicting the circular motion produced by the mixer of the present invention by showing a paint can in four different positions.
Figure 4D:
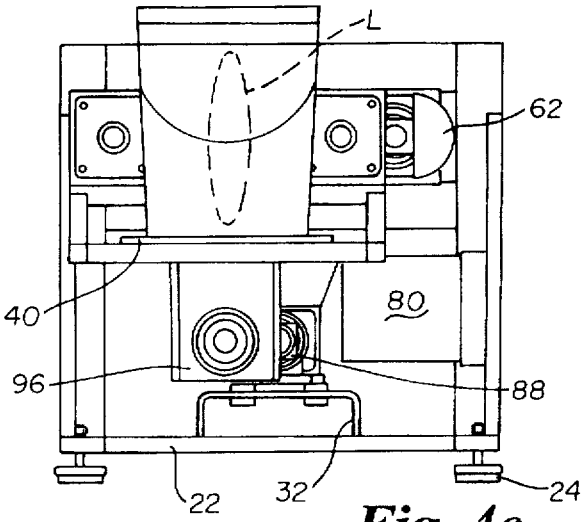
Figure 4B:
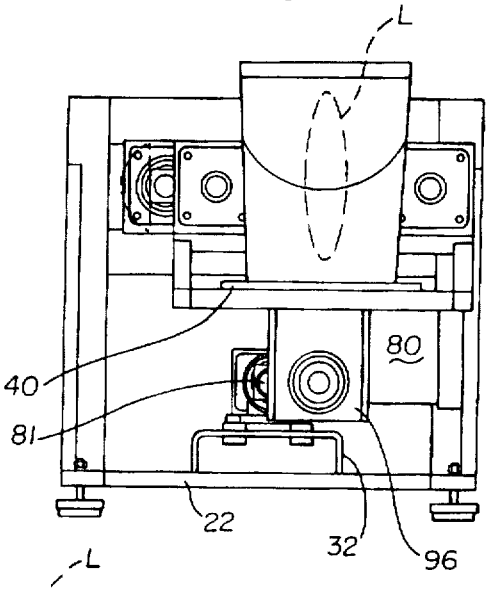
Figure 4C:
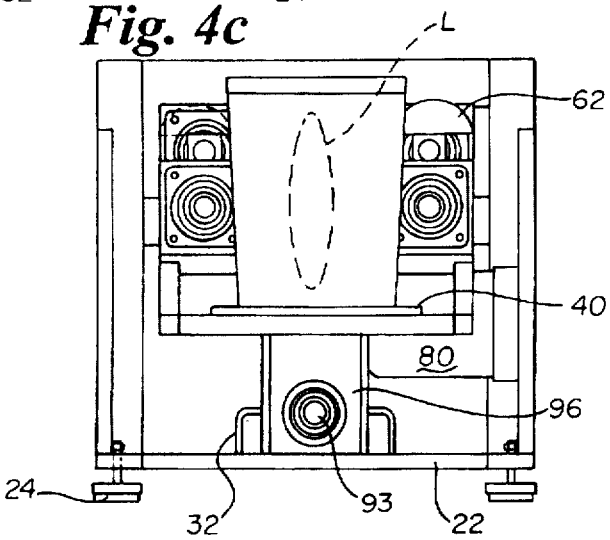

Referring to FIG. 3, the output of the motor 80 is coupled to a gear reducer 82 (e.g., a 10:1 to a 12:1 gear reducer such as a Winsmith reducer, model 920 MDT). At the gear reducer 82, the output of the motor 80 is reduced, turned 90° and output to a solid shaft 81 extending along the front to rear longitudinal axis A of the device 10 and into a bearing housing 84. The bearing housing 84 provides a split bearing arrangement with a suitable roller bearing 85 mounted generally at the forward and rearward ends thereof, as shown in FIG. 3. This split bearing arrangement provides rigidity and helps support the cantilevered load of the subframe 20 and a container of paint as the machine 10 is operated.

At the forward end of the bearing housing 84, an offset crankshaft 86 couples the forward end of the shaft 81 to the subframe 20. The offset crankshaft 86 includes a solid, straight link 88 at one end of which is a stub shaft 90 coupled by suitable collar 92 to the forward end of the shaft 81 extending from the bearing housing 84. At the other end and opposite side of the link 88, another stub shaft 93 is coupled to a fixed bearing 94 mounted on a flange 96 extending downwardly from the bottom of the subframe 20. With further reference to FIG. 3, the motor is fixedly connected to the main frame 18 and the gear reducer 82 and the bearing housing 84 are fixed to the U-shaped support member 32 through vibration isolator pads, each indicated at 98.

Referring to FIGS. 2 and 3, the cabinet shroud 100 for enclosing the operating mechanisms of the device 10 of the present invention is depicted. The shroud 100 includes a control panel 102 obliquely angled upwardly and supporting a suitable control array 104 including control inputs such as a timer display, start and stop switches, an emergency stop switch, circuit breakers and the like. A front, hinged access door 105 is provided for accessing the container receiving support 16. Although not shown, suitable connection to a remote power source may be provided in the form of well known means such as electrical power cords or direct hard wired connections, depending upon the site of use of the machine 10.

In use, the operation of the mixing machine 10, i.e., the mixing method of the present invention, is described as follows. First the access door 105 of the cabinet 100 is opened. Referring to FIG. 5, if a five-gallon can of paint is to be mixed, it is simply lifted until just above the bottom plate 40 and moved rearwardly toward and into the well 67 of the machine 10 until it triggers the sensor 78. If automatic, self-opening adaptor flanges 68 are provided, the sensor actuates or releases an appropriate opening mechanism (e.g., an electromagnetic or gear motor arrangement), whereupon the adaptor flanges 68 open so that the well 67 can accommodate the five-gallon can. With continued reference to FIG. 5, the motor-operated automatic clamp is actuated, driving the top plate 70 downwardly until it contacts the top of the five-gallon can. In the case of mixing a one-gallon can G or a case of one-gallon cans C, each shown in phantom in FIG. 5, the flanges 68 are left in place over the well 67 (i.e., sensor 78 will not be triggered by the insertion of the container to be mixed) and the single one-gallon can G or the case of one-gallon cans C is placed along the surface provided by the top of the adaptor flanges 68, which surface is parallel to and above the bottom plate 40. The access door 105 may then be closed and the automatic clamp assembly is operated to drive the top plate 70 downwardly in the same fashion as that described relative to the five-gallon pail.

Having placed the paint can or cans in the mixing device 10, the machine 10 may be turned on and set of the desired time. This results in the rotation or rotary movement of the output shaft of the motor 80. The output is reduced and turned 90° in the gear reducer 82 and transmitted through the bearing housing 84. The offset crankshaft arrangement 86 transmits and converts the rotary output of the motor 80 into circular motion of the subframe 20 and the container receiver 16 generally. This planar circular motion is depicted in FIGS. 4A-D and produces in the liquid (paint or other liquid) in the can a mixing path including a liquid path component L and an air path component T. The air path component T is present in most containers because a small amount of air is usually contained along with the liquid. The liquid path component L is generally vertical but slightly elliptical, and the air path component T is generally transverse or angular relative to the liquid path component L. When the mixing is completed, the machine is deactivated, the automatic clamp is operated to release the can or cans, the door 105 is opened and the can or cans are removed.

Although FIG. 5 depicts an automatic clamping mechanism for holding a container in place, other container holding systems known in the art are possible and contemplated. For example, a manual arrangement could be used wherein a container is held in place relative to the bottom plate 40 by mechanically adjusted clamps or a plurality of springs attached to the plate 40 and located generally about the circumference of the container. The top plate motorized moving mechanism depicted in FIG. 5 could be replaced by a plate lowered and raised by a manual screw or a lever-arm operated hydraulic system. Similarly, the adaptor flanges 68 could be raised or lowered over the open top of the well 67 by hand. A safety override cutoff switch could be coupled to the access door 105. A second drive motor, similar to the first motor 80, but smaller, could be mounted on or under the subframe 20 to spin a turntable (not shown, but replacing or supplementing the platform 40) mounted on the top of the subframe 20. A can of paint would be suitably attached to the turntable to drive it. Thus, a spinning motion could be combined with the circular motion produced by the present invention.

Figure 7:
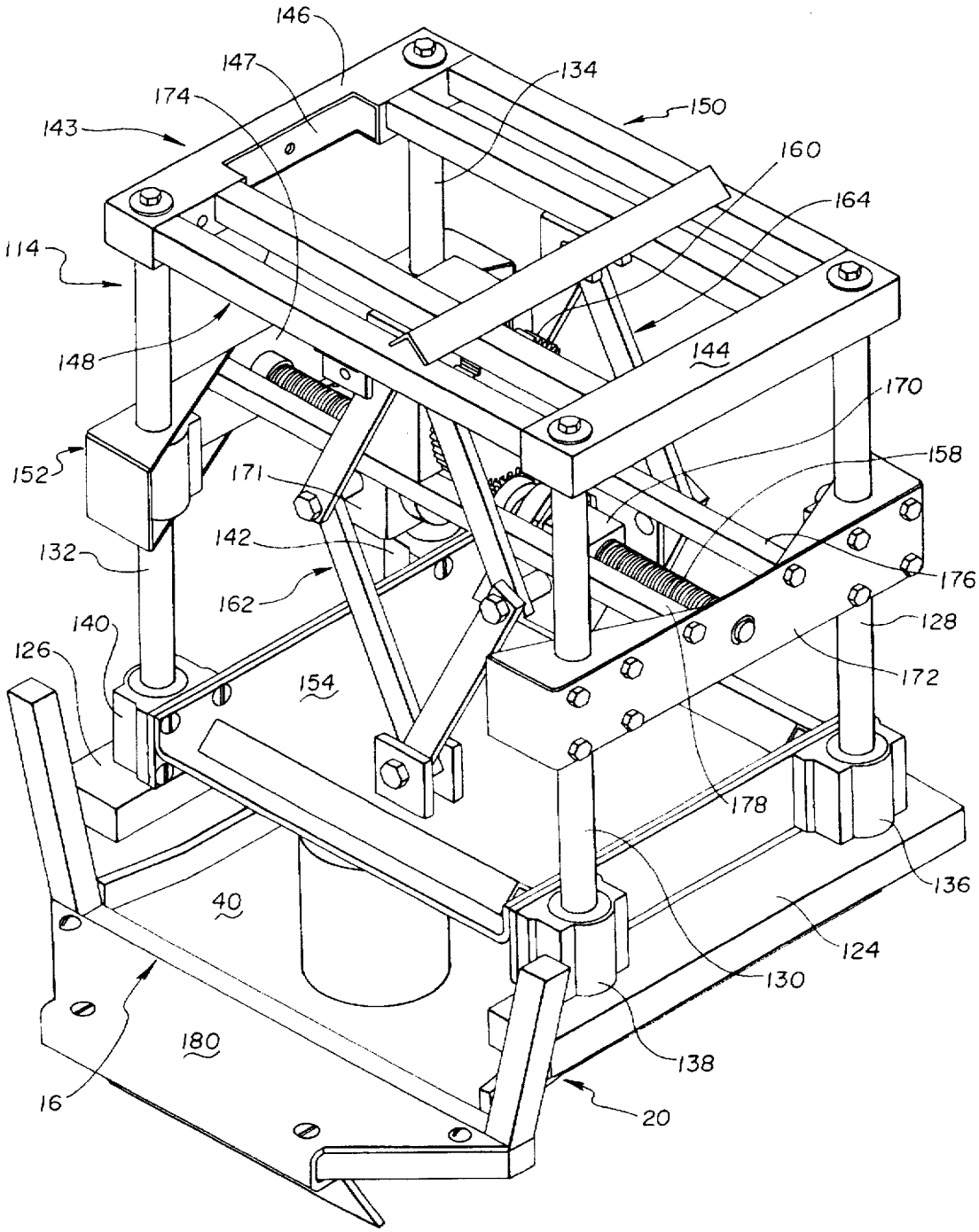
FIG. 7 is an isometric view of the container receiving and clamping mechanism of the embodiment of the present invention depicted in FIG. 6 in one operational position.
Figure 8:
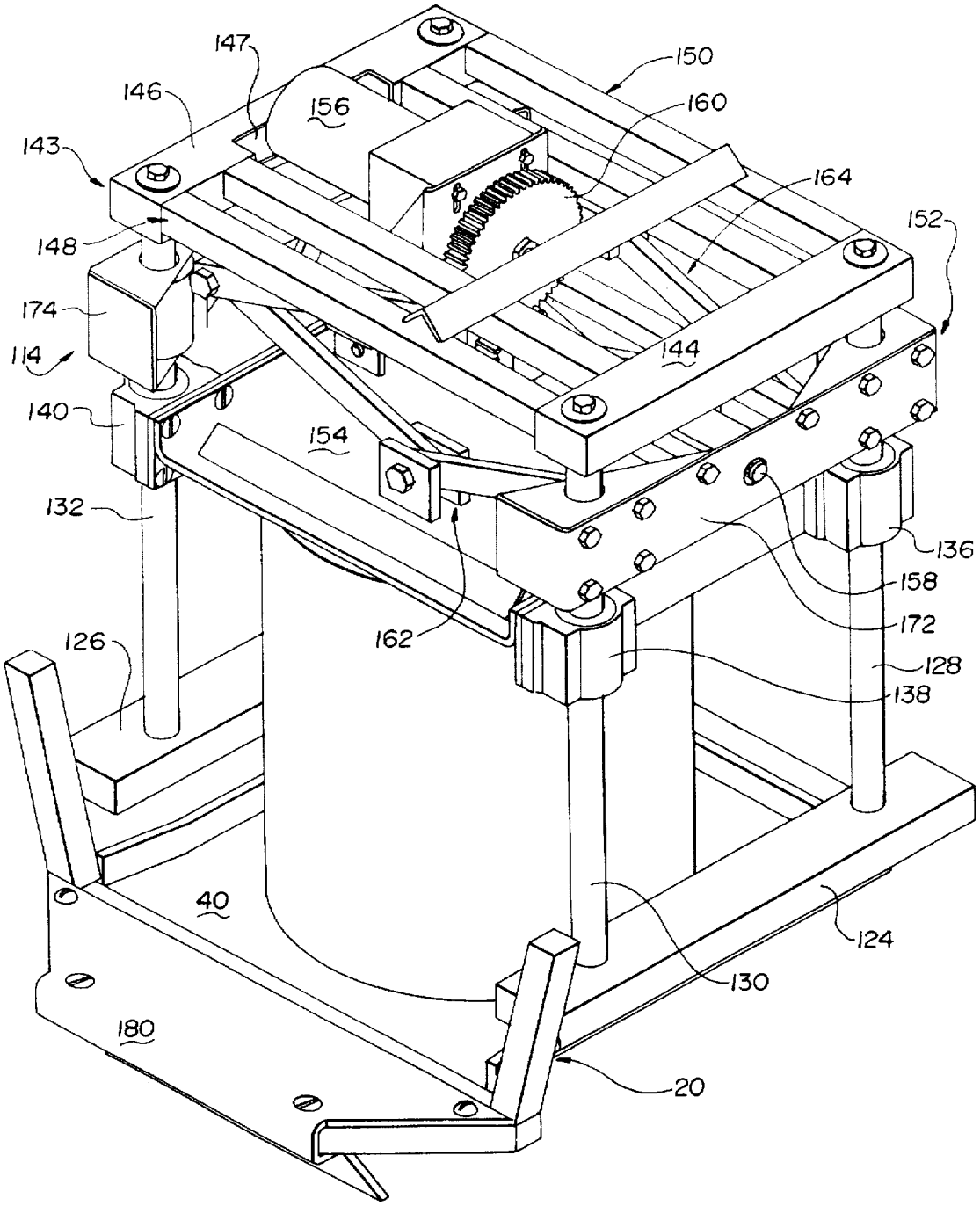
FIG. 8 is a view similar to that of FIG. 7 with the container receiving and clamping mechanism in a second operational position.
Figure 9:
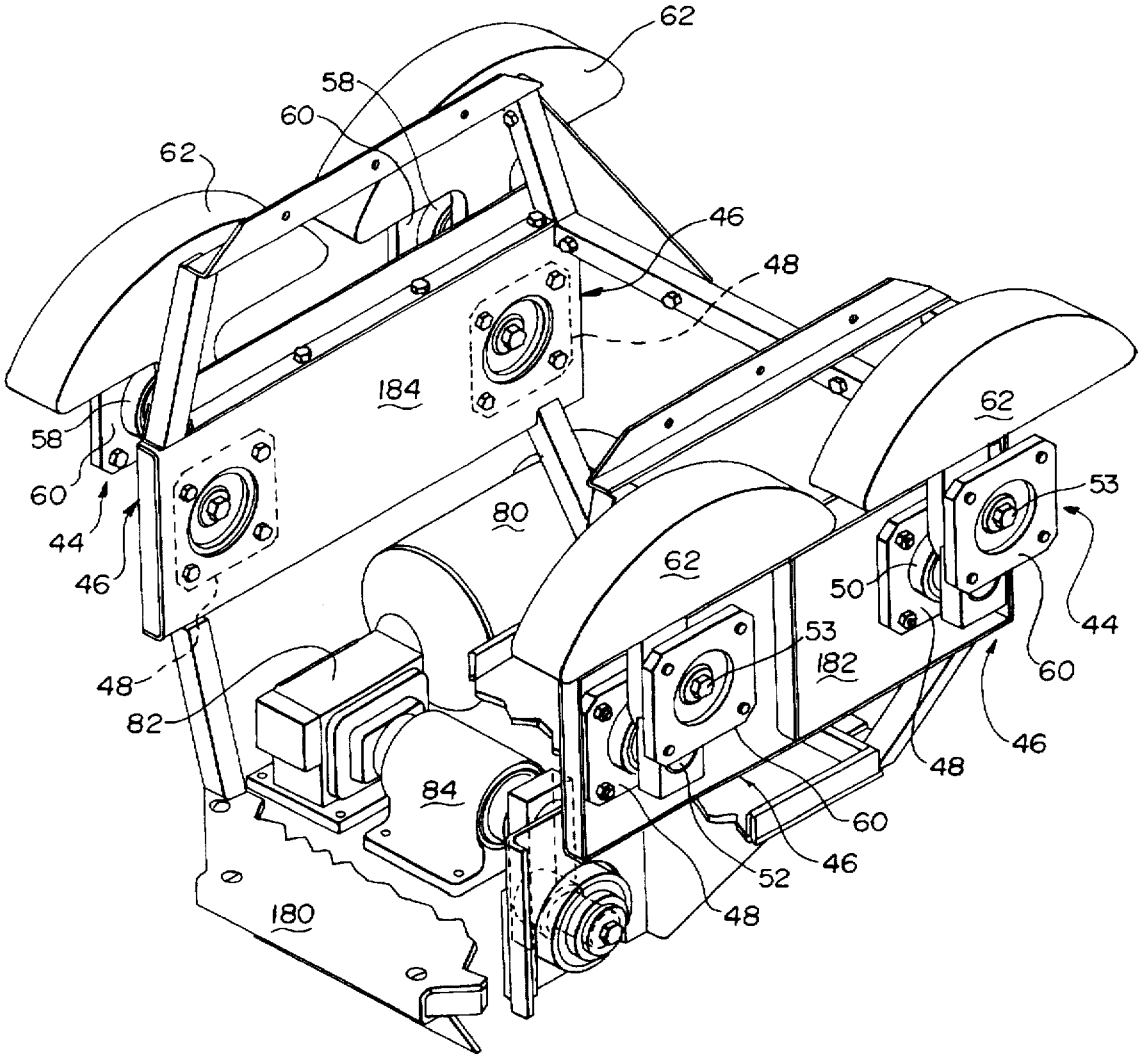
FIG. 9 is an isometric view of the counterweight assembly of the embodiment of the present invention depicted in FIG. 6.

FIGS. 6–9 depict a second embodiment, and portions thereof, of the mixing apparatus 10 of the present invention. The second embodiment differs from the embodiment described above in that, as shown in FIG. 6, it includes control and soft start modules 110, 112, respectively, and a different clamping mechanism, indicated generally at 114 in FIGS. 7 and 8. As shown in FIG. 9, the second embodiment includes four counterweights 62. It should also be appreciated that, while the operational mixing motion of the second embodiment is substantially identical (i.e., circular) to the planar circular mixing motion depicted in FIGS. 4A–D, the mixing motion occurs in a vertical plane rotated ninety degrees from that depicted in FIGS. 4A–D, i.e., the horizontal component of the motion of the embodiment depicted in FIGS. 6–9 is from front to rear of the mixer 10, as viewed in FIG. 6, rather than from side-to-side as depicted in FIG. 4A–D. Also, certain components of the main mixing motion drive and transmission means (e.g., motor 80, gear reducer 82, bearing housing 84, etc.) have been repositioned, but the function is as described above.

Figure 6:
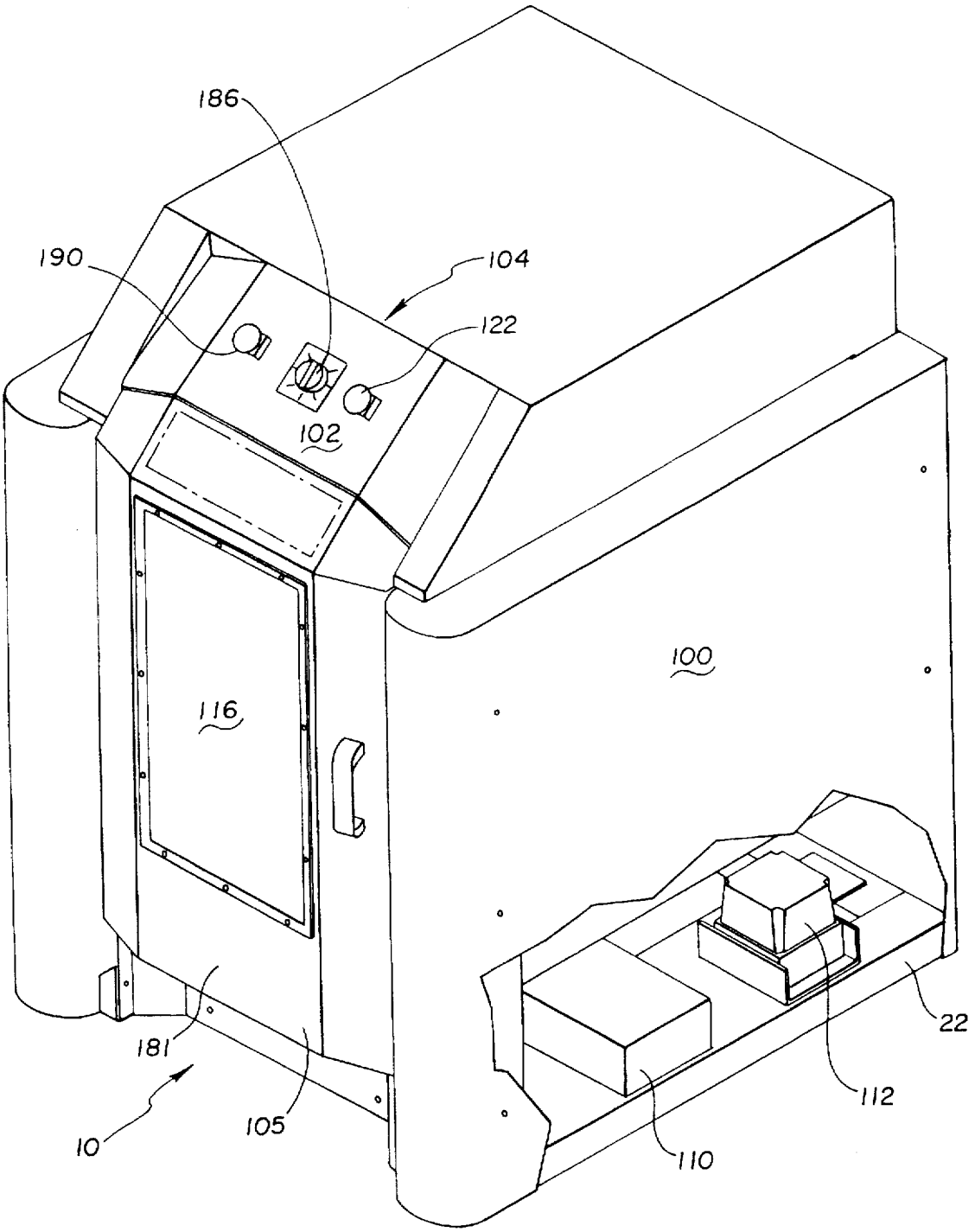
FIG. 6 is an isometric view of another, preferred embodiment of the present invention with portions of the shroud or cabinet broken away to show the control modules.

Referring then to FIG. 6, the shroud or cabinet 100 completely encloses the working components of the mixer 10 of the present invention. The cabinet 100 includes a control panel 102 with a control array 104 displayed and mounted thereon. A front, hinged access door 105 provides for access and may include a clear plexiglass window 116. Portions of the cabinet, specifically portions of the lower right side wall, are broken away to show the location of an easily replaceable "plug-in/plug-out" control module 110 and "plug-in/plug-out" soft start control module 112. The control module 110 is fabricated from commercially available electronic components, include logic or microprocessor circuitry, and controls and operates all aspects of normal operation of the mixer 10 including the operation of the automatic clamping mechanism (as will be described herein below), mixing operations including rpm, timing and clamping operations (also as described herein below). Additionally, the control module 110 senses, operates and controls safety features associated with the present invention including door monitoring, emergency stop commands (through stop button 122) and circuit breaker elements for reacting to current surges. The control module 110 operates at 115 volts of alternating current, converting some of the current into direct current for drive motor operations. The modules 110, 112 are replaceable and easily removable, connection and disconnection being provided by a typical male/female, plug/socket arrangement or the like. A locking system may be provided, for example, a set screw (not shown).

The soft start control module 112 is also a "plug-in/plug-out" module and is provided to reduce or eliminate the initial starting jolt when the machine 10 is actuated. This is accomplished by bringing the drive motor 80 up to full operating speed over a period of time, thereby prolonging the life of the motor 80 as well as bearings and moving portions of the machine 10. A soft start control module 112 suitable for use in the present invention is module Model No. ES-1, Part No. 1311300 made by Nordic Controls Company, of Batavia, Ill.

Referring to FIGS. 7 and 8, the preferred embodiment of the clamping mechanism 114 is depicted. The clamping mechanism 114 includes the bottom clamping plate 40 which is fixedly attached (welded) to the subframe 20. A pair of side rails 124, 126 are attached (welded) to the sides of the subframe 20. Four generally vertical guide columns 128, 130, 132, 134 are fixedly connected (bolted) to the respective side rails 124, 126. A linear bushing 136, 138, 140, 142 is slidably received on each column. A top clamping frame assembly 143 is fixedly connected (bolted) to the columns adjacent to the upper end thereof. The top clamping frame assembly 143 comprises a pair of parallel upper side beams 144, 146 and a pair of front and rear compound beams indicated at 148, 150, respectively. The side beam 146 includes a generally central notch 147.

The automatic clamping mechanism 114 includes a floating or movable clamp drive support carriage assembly, indicated generally at 152. The clamp drive support carriage assembly 152 is between the bottom clamping plate 40 and the top clamping frame assembly 143, and is shown in FIG. 7 in a fully extended lower position and in FIG. 8 in a fully contracted upper position for accommodating larger paint containers such as five gallon containers. Thus, the clamping mechanism 114 is a multi-size clamping mechanism. The clamp drive support carriage assembly 152 includes a top clamping plate 154 operably connected to an electric motor 156. As shown in FIG. 8, the motor 156 is connected through a gear 160 to a elongated, threaded lead screw 158 carried by the drive assembly 152. The drive assembly 152 includes two substantially identical 4-bar linkage members, a front linkage member 162 and a rear member 164. The upper two bars of each scissors-like linkage member 162, 164 are pivotally connected at their upper ends to the compound beams 148, 150. The lower two bars of each linkage member 162, 164 are pivotally connected to the top clamping plate 154. At their midpoints, each linkage 162, 164 (the other end of each of the four bars) is pivotally connected to one of two ball nut followers 170, 171 which follow the lead screw 158. The drive assembly 152 includes two side rail frame members 172, 174 and two crossing beam members 176, 178 for rigidity and for carrying the motor 156 and lead screw 158. Each of the side rails 172, 174 is slidably mounted on the columns 128, 130, 132, 134 by a linear bushing identical to the bushings 136, 138, 140, 142 to which the top clamping plate 154 is connected. Aside from electrical connections to the clamp motor 156, the clamping assembly 114 is connected only to the subframe at the side rails 124, 126 and moves with the subframe 20.

Referring to FIG. 9, the idling or secondary linkage arrangement 44 is depicted so that the nested relationship between the clamping mechanism 114 and the secondary linkage arrangement 44 of the second embodiment can be perceived. It should be understood that the loading ledge 180 depicted in FIGS. 7–9 is just behind the lower edge 181 of the door 105 (shown in FIG. 6). As depicted in FIG. 9, the second embodiment of the mixer 10 of the present invention includes four substantially identical linkage members, each indicated generally at 46, each carrying a counterweight 62. Each linkage member 46 is connected to the main frame 18 at flanges 60 (the base 22 may be adapted as necessary to include two parallel, upstanding wall-like supports at each side thereof and to the subframe 20, specifically to two side plates 182, 184 carried by the subframe 20, at flanges 48.

Each linkage member 46 includes an elongated link member 54 which is pivotally secured to the mainframe 18 at a pivot point 53 via the bearing 58. A first end of the link 54 is pivotally secured to the subframe 20 via the shaft 52 and the bearing 50, while a second end of the link 54 is fixedly secured to the counterweight 62. During operation, the entire subframe 20 with attached container and the counterweights 62 are pivoted about the pivot point 53. The subframe 20 is pivoted through a linkage radius defined as the distance between the pivot point 53 and the center of the shaft 52. In the preferred embodiment, this distance is about 2–4 inches resulting in a total displacement of 4–8 inches. Preferably the total displacement is greater than 4 inches with a most preferred displacement being about 7 inches. In this most preferred embodiment, the radial distance between the pivot point 53 and the shaft 52 is about 3½ inches. Because the multi-sized container clamp is adapted to clamp a variety of container sizes between a smallest size and a largest size, a variety of different forces are exerted on the main frame as the subframe 20 and attached container (with varying size) is rotated about the pivot point 53.

Each of the counterweights has a center of gravity (or center of mass) which is spaced from the pivot point 53 by a radial distance referred to as the counterweight connection distance. During operation, the counterweights 62 are pivoted about the pivot point 53 through a linkage radius equal to this counterweight connection distance. The size of the counterweights and their counterweight connection distance are dictated in part by the weight of the subframe and clamping mechanism and in part by the weight range of the various sized containers that are capable of being mixed with the present invention. In the preferred embodiment, the weight of the subframe 20 and clamping mechanism is in the range of 140 to 150 pounds with the weight range of paint being zero to 80 pounds. During mixing operation, this weight ranging approximately from 140 to 235 pounds is pivoted about the pivot point 53 through its linkage radius. The counterweights 62 are selected so that the forces created by the counterweights acting through their counterweight connection distance balances the forces created by the weight of the subframe and a mid-sized container acting through its linkage radius.

In use, the operational parameters and mixing motion of both embodiments of the present invention are substantially similar. However, as described above and depicted in the drawings, the plane of the horizontal component of the mixing motion of the second embodiment is from front to rear of the machine 10, and the second, preferred embodiment includes the automatic, driven clamping mechanism 114, the modules 110, 112 and four linkage members 46, each including a counterweight 62. Two of the linkage members 46 are generally coplanar on each side of the subframe 20 and the linkage members 46 are, thus, arranged in two generally parallel coupling arrangements, one on each side of the subframe 20 and a container carried thereby, and on both sides of the drive means 14.

The operational sequence of the second embodiment depicted in FIGS. 6–9 may be outlined as follows. The door 105 is opened and a container is placed on the lower clamp plate 40. The door 105 is closed, which closes a door limit switch (not shown) and actuates the control logic of the control module 110. The timer switch 186 is set for the desired mixing time. The control module 110 then operates the clamp motor 156, automatically lowering the top clamping plate 154 until the top plate 154 contacts the container with a clamping force of approximately 300–400 pounds. During both raising and lowering, the clamp drive support carriage 152 moves at one half the rate at which the top clamp plate 154 moves. Thus, for example, when the top clamp plate 154 is raised two inches, the drive support carriage 152 moves upwardly one inch. As soon as the clamping mechanism 114 reaches the preset force, mixing motion (as depicted in FIG. 4A–D) is initiated by the mixing motion drive means (motor 80, etc.) and, in normal operation, continues until the selected mix time elapses. After a delay of approximately six seconds after the mixing time elapses, the clamp mechanism 114 is automatically raised about five inches. Both the delay time period and distance raised may be selectively varied.

The control module 110 provides, and thus the control sequence includes, the following features. If clamp force is diminished or lost during the timed mixing or prior to initiating mixing, mixing automatically stops or will not proceed, respectively. If the door 105 is opened while mixing is underway, mixing stops. If no paint container is loaded into the machine 10, the clamp will travel downwardly, i.e. the top plate 154 will be driven toward the bottom plate 40, but the machine 10 will not initiate mixing motion until the preset clamping force is achieved. The control panel 102 is provided with a raise clamp button 190, provided to raise the top clamp plate 154 initially to accommodate large containers, such as the five gallon can shown in FIG. 8. This is necessary because upon completion of mixing, the top clamping plate 154 is automatically raised five inches above the top of a container.

Although a description of a preferred embodiment has been presented, various changes, including those mentioned above, could be made without deviating from the spirit of the present invention. It is desired, therefore, that reference be made to the appended claims rather than to the foregoing description to indicate the scope of the invention.

What is claimed is:

1. A securing apparatus for securing a container of fluid to be mixed in a mixing device having a main frame and a subframe movably coupled to the main frame, said securing apparatus comprising:

a frame assembly carried on said subframe and including a frame assembly top;

a first clamping member movably supported by said frame assembly and a second clamping member mounted on the subframe, said second clamping member generally parallel to the first clamping member; and drive means carried by said frame assembly for moving said first clamping member toward and away from said second clamping member, wherein said drive means comprises a motor and a scissors linkage operably coupling the motor and the first clamping member.

2. A securing apparatus for securing a container of fluid to be mixed in a mixing device having a main frame, a subframe movably coupled to the main frame, a mixing motor mounted on the main frame for producing a rotary output and a transmission operably coupling said mixing motor and the subframe for converting said rotary output to a circular movement of the subframe, said securing apparatus comprising:

a frame assembly including a plurality of columns vertically mounted on said subframe and at least two beams;

a first clamping plate fixed to said subframe and a second clamping plate movably supported by said frame assembly, said first and second clamping plates generally parallel; and a clamping motor and linkage carried by said frame assembly for moving said second clamping plate toward and away from the first clamping plate, wherein said linkage comprises a lead screw operably coupled to the clamping motor, two followers movably mounted on the lead screw and a pair of scissors linkages each having a first end, second end and midpoint, and each connected at the first end to one of the beams, at the second end to the second clamping plate, and at the midpoint to one of the two followers.

3. The securing apparatus according to claim 2, wherein the first and second clamping plates are generally horizontal.

4. A mixing apparatus for mixing a substance in a closed container, said mixing apparatus comprising:

a main frame and a subframe for carrying the container, said subframe movably coupled to the main frame for movement in a circular orbit having a constant radial displacement; and actuating means carried by the main frame and operably linking the main frame and the subframe for actuating the movement of the subframe, said actuating means including a first linkage moveable in a circular orbital path within a first vertical plane and a second linkage moveable in a circular orbital path within a second vertical plane parallel to and spaced from said first vertical plane.

5. The mixing apparatus of claim 4 wherein said subframe is positioned between said first and second vertical planes.

6. The mixing apparatus according to claim 5 including a third, drive linkage moveable in a circular orbital path.

7. The mixing apparatus according to claim 6, wherein said circular orbit has a diameter ranging from four to eight inches and a speed of less than 200 rpm.

8. The mixing apparatus according to claim 5, wherein said third, drive linkage is positioned in a third vertical plane between said first and second vertical planes.

9. The mixing apparatus according to claim 4, wherein said subframe is movably coupled to the main frame at least three points, at least one of which is non-coplanar with respect to the other points.

10. The mixing apparatus according to claim 4, wherein said main frame includes a generally horizontal base and two upstanding side supports, the subframe and the movement thereof between said side supports.

11. The mixing apparatus according to claim 10, including a door generally perpendicular to said first and second vertical planes.

12. The mixing apparatus according to claim 4, and a multi-size container clamp carried by the subframe and including two clamp members, one of said clamp members movable relative to the other to clamp different sizes of containers between said two members.

13. The mixing apparatus according to claim 12, further comprising a unitized control module carried on the main frame for providing electronic control of mixing, clamping and safety operations of the mixing apparatus, said mixing apparatus and control module each having a complementary portion of connection means for connecting and disconnecting said mixing apparatus and control module, whereby one of said control modules may be replaced by a like control module.

* * * * *